US011135648B1

(12) United States Patent
Maple et al.

(10) Patent No.: US 11,135,648 B1
(45) **Date of Patent: *Oct. 5, 2021**

(54) GOLF CLUB HEAD MANUFACTURING METHOD

(71) Applicant: Callaway Golf Company, Carlsbad, CA (US)

(72) Inventors: Robert Maple, Chula Vista, CA (US); Michael J. Kaplan, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/331,944

(22) Filed: May 27, 2021

Related U.S. Application Data

(63) Continuation of application No. 16/725,048, filed on Dec. 23, 2019.

(Continued)

(51) Int. Cl.
*B22F 3/22* (2006.01)
*B22F 3/10* (2006.01)

(Continued)

(52) U.S. Cl.
CPC ..... *B22F 3/225* (2013.01); *B22F 1/0059* (2013.01); *B22F 3/1021* (2013.01); *B22F 3/24* (2013.01); *B22F 5/00* (2013.01); *A63B 53/0487* (2013.01); *B22F 2003/247* (2013.01); *B22F 2202/13* (2013.01)

(58) Field of Classification Search
CPC ..... A63B 53/0487
See application file for complete search history.

(56) References Cited

U.S. PATENT DOCUMENTS 5,665,014 A * 9/1997 Sanford ..... B22F 3/225 473/345
6,860,820 B2 * 3/2005 Specht ..... A63B 60/00 473/312

(Continued)

FOREIGN PATENT DOCUMENTS

JP 11104284 A * 4/1999

OTHER PUBLICATIONS

JP-11104284-A English language translation (Year: 1999).*

(Continued)

*Primary Examiner* — Anthony J Zimmer
*Assistant Examiner* — Sean P. O'Keefe
(74) *Attorney, Agent, or Firm* — Rebecca Hanovice; Michael Catania; Sonia Lari

(57) ABSTRACT

A method of manufacturing golf club heads, and particularly putter heads, using metal injection molding and plasma polishing is disclosed herein. The metal injection molding process is facilitated with a base tool having a golf club head shaped cavity and interchangeable hosel core tools. The use of interchangeable hosel core tools allows a manufacturer to quickly and easily alter the overall shape of the putter head, and greatly reduces the number of base tools needed to create an entire line of putter heads with different hosel designs. This plasma polishing process yields a glossy cosmetic shine appearance, increases corrosion and rust resistance, and provides a smoother surface to which post process operations can adhere.

6 Claims, 7 Drawing Sheets

Related U.S. Application Data

(60) Provisional application No. 62/924,101, filed on Oct. 21, 2019.

(51) Int. Cl.

| | |
|---|---|
| ***B22F 1/00*** | (2006.01) |
| ***B22F 3/24*** | (2006.01) |
| ***B22F 5/00*** | (2006.01) |
| *A63B 53/04* | (2015.01) |

(56) References Cited

U.S. PATENT DOCUMENTS

| | | | | |
|---|---|---|---|---|
| 7,396,296 | B2 | 7/2008 | Evans | |
| 8,007,370 | B2 | 8/2011 | Hirsch et al. | |
| 8,241,145 | B2 | 8/2012 | Hirsch et al. | |
| 10,335,653 | B1 | 7/2019 | Daraskavich et al. | |
| 10,960,278 | B2 * | 3/2021 | Serrano | A63B 60/50 |
| 2016/0151861 | A1 * | 6/2016 | Soracco | B22F 7/06 419/7 |

OTHER PUBLICATIONS

Wang, Ji, et al. "Influence of voltage on electrolysis and plasma polishing." Proceedings of the 2017 International Conference on Manufacturing Engineering and Intelligent Materials (ICMEIM 2017), Guangzhou, China. 2017. (Year: 2017).*

Podhorský, Štefan, and Martin Bajčičák. "Plasma polishing of stainless steels—the electrolyte concentration vs. gloss level." Vedecké Práce Materiálovotechnologickej Fakulty Slovenskej Technickej Univerzity v Bratislaveso Sídlom vTrnave 26.42 (2018): 171-176 (Year: 2018).*

* cited by examiner

GOLF CLUB HEAD MANUFACTURING METHOD

CROSS REFERENCES TO RELATED APPLICATIONS

The present application is a continuation of U.S. patent application Ser. No. 16/725,048, filed on Dec. 23, 2019, which claims priority to U.S. Provisional Patent Application No. 62/924,101, filed on Oct. 21, 2019, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to metal injection molded golf club heads, including putter heads, and methods of manufacturing and finishing such heads.

Description of the Related Art

Manufacturers typically machine fully milled golf club heads (particularly putters) from billet or forged stainless steel precursor structures. These precursor structures require the inclusion of a significant amount of stock material, and involve a great deal of CNC fixturing to obtain desired tolerances.

Once these golf club heads are machined within a desired tolerance, they are typically polished using manual or automated processes over grinding wheels. The disadvantage of this process is that many small or difficult to reach areas cannot be polished. Physical vapor deposition (PVD) and blasting methods are used to cover these difficult to reach surfaces in order to improve cosmetic and protect surface from oxidization. Both of these process increase the overall cost of product and significantly change the overall cosmetic appeal of putter head. Electropolishing is another option for finishing complex contoured head shapes, but is a caustic process that uses hazardous chemicals and removes a great deal of material from the head.

In view of the problems with machining and finishing club heads described above, there is a need for more efficient, cost-effective, and ecologically sound methods of manufacturing and finishing golf club heads, particularly putter heads.

BRIEF SUMMARY OF THE INVENTION

The present invention is directed to a method of manufacturing a golf club head by metal injection molding material into a golf club head tool or mold having replaceable and interchangeable hosel cores, cooling the tool or mold until an intermediate product is formed, and then polishing the intermediate product with a plasma polishing process to create a finished head.

One aspect of the present invention is a method comprising the steps of blending in a mixer a metal powder with a polymer to create a stock feed material, heating the stock feed material in a hopper to create a liquid metal material, providing a first tool comprising at least one golf club body-shaped chamber, providing a plurality of hosel core tools, engaging one of the plurality of hosel core tools with the first tool to create a combination tool, injecting the liquid metal material into the combination tool, cooling the liquid metal material within the combination tool to create an intermediate product, and plasma polishing the intermediate product to create a finished golf club head.

In some embodiments, the step of plasma polishing the intermediate product may further comprise the steps of placing the intermediate product on a metal tree housing, placing the metal tree housing into a plasma polishing chamber, increasing the temperature and voltage within the plasma polishing chamber, and placing the intermediate product into solution. In other embodiments, the metal powder may be 304 stainless steel. In any of the embodiments, the golf club head may be a putter head. In another embodiment, the method may further comprise the step of machining the intermediate product, which step may occur after the step of cooling the liquid metal material and before the step of plasma polishing the intermediate product. In another embodiment, the step of providing a plurality of hosel core tools may comprise providing at least three hosel core tools, each of which may comprise a hosel cavity having a unique shape.

Another aspect of the present invention is a method comprising the steps of blending a metal powder with a polymer to create a stock feed material, heating the stock feed to create a liquid material, providing a base tool with a putter head-shaped cavity and a hosel cavity, providing a plurality of hosel core tools, each having a hosel cavity with a unique shape, inserting one of the plurality of hosel core tools into the hosel cavity to create a combination tool with a combination cavity, injecting the liquid material into the combination cavity, cooling the combination tool so that the liquid material hardens into a first intermediate product having the approximate size and shape of the combination cavity, removing the first intermediate product from the combination tool, heating the first intermediate product to melt away the polymer material and create a second intermediate product having a smaller size than the first intermediate product, and finishing the second intermediate product to create a putter head.

In one further embodiment, the step of finishing the second intermediate product may further comprise the steps of affixing the second intermediate product to a tree housing, placing the tree housing into a chamber comprising an aqueous solution, increasing temperature and voltage levels within the chamber to anodically polarize the second intermediate product, placing the second intermediate product into the aqueous solution to create the putter head, and removing the putter head from the plasma polishing chamber. In a further embodiment, the aqueous solution may comprise 2.5-5% NaCl and water. In another embodiment, the temperature may be no greater than 100° C. and the current is may be no less than 200 volts.

Yet another aspect of the present invention is a method comprising the steps of metal injection molding at least one putter head, affixing the at least one putter head to a metal tree housing, loading the metal tree housing into a plasma polishing chamber comprising an aqueous solution, increasing temperature and voltage levels within the plasma polishing chamber to anodically polarize the at least one putter head, placing the at least one putter head into the aqueous solution, and removing the at least one putter head from the plasma polishing chamber. In some embodiments, the aqueous solution may comprise NaCl solute and water, and in a further embodiment, the aqueous solution may comprise 2.5-5% NaCl solute. In an alternative embodiment, the temperature may be no greater than 100° C. and wherein the current may be no less than 200 volts. In another embodiment, the at least one putter head may comprise a plurality of putter heads, each of which may comprise a hosel, and each putter head may be affixed to the metal tree housing at its hosel. In any of the embodiments, the at least one putter head may comprise a stainless steel material.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
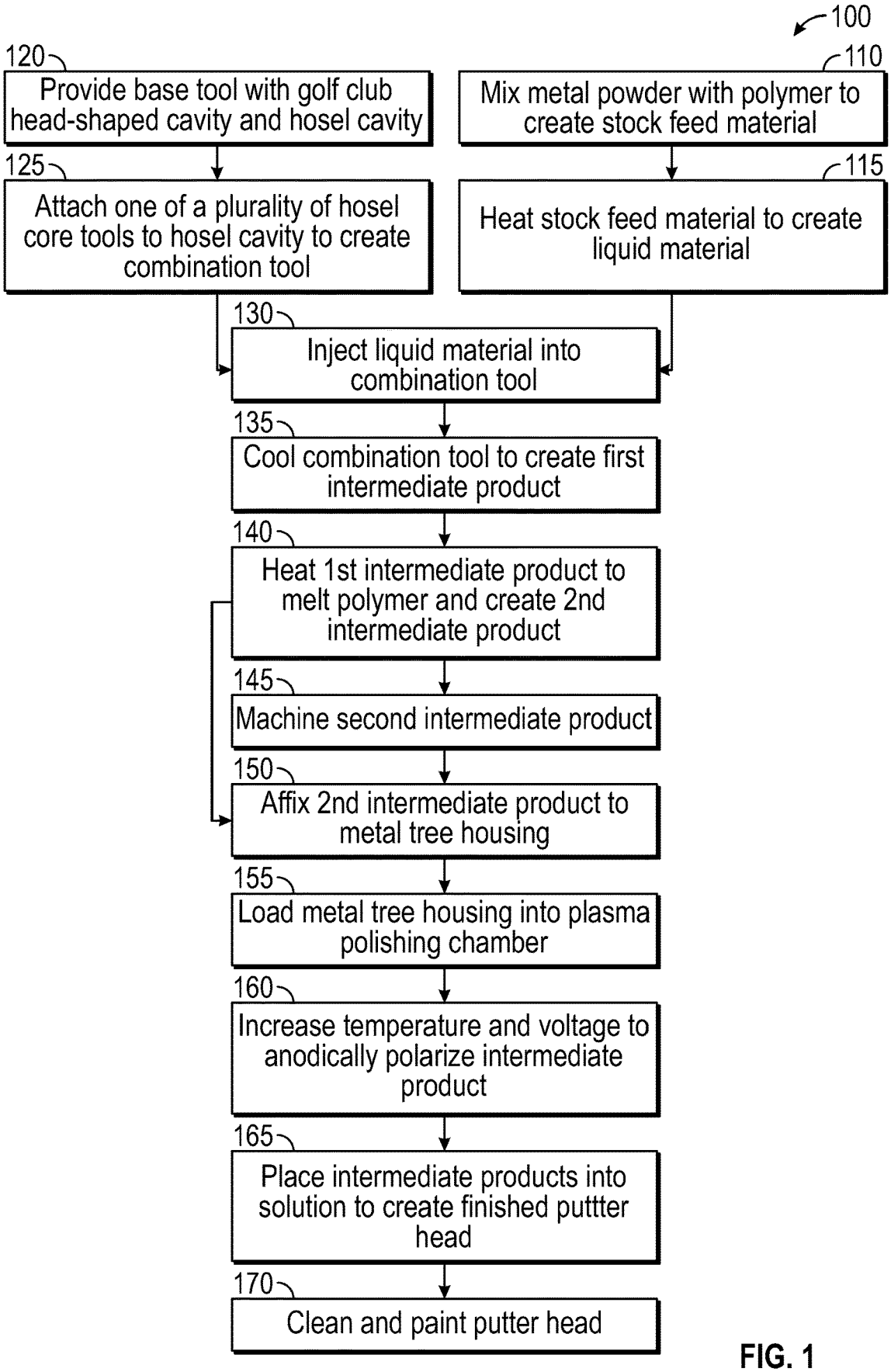
FIG. 1 is a flow chart describing a preferred golf club head manufacturing method of the present invention.
Figure 2:
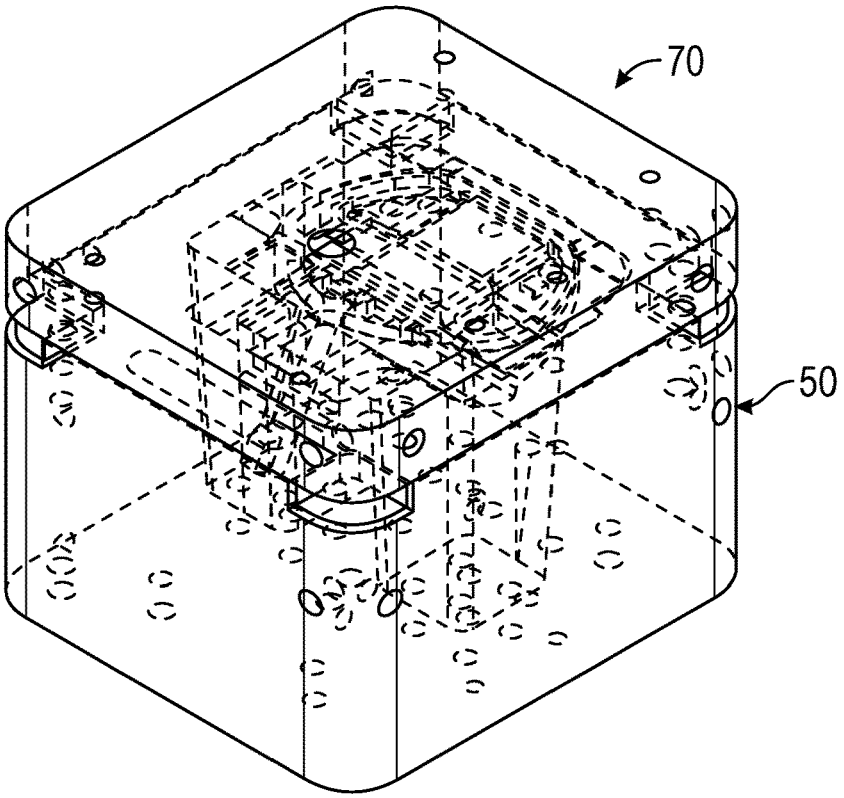
FIG. 2 is a transparent side perspective view of an exemplary golf club head engaged with a combination tool of the present invention.
Figure 3:
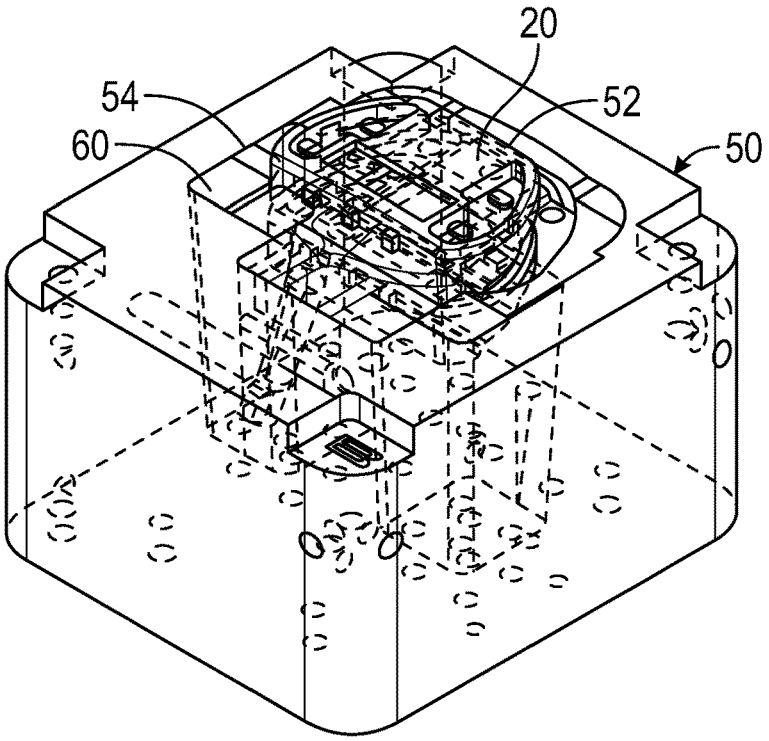
FIG. 3 is a top perspective view of the embodiment shown in FIG. 2 with its cover removed.
Figure 4:
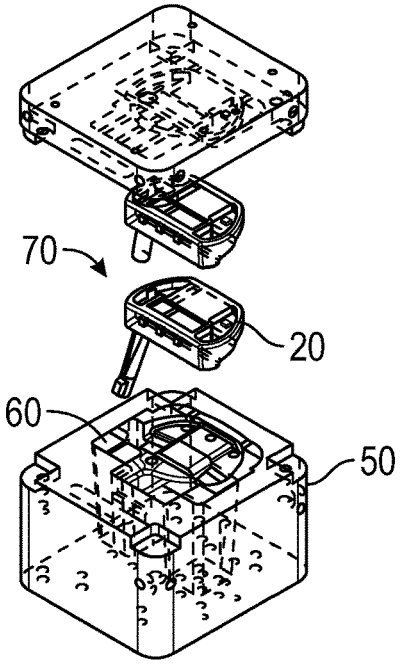
FIGS. 4-6 are exploded views of the embodiment shown in FIG. 2.
Figure 5:
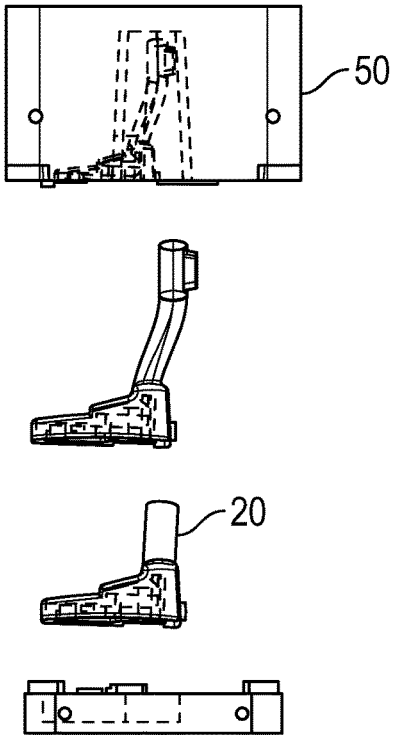
Figure 6:
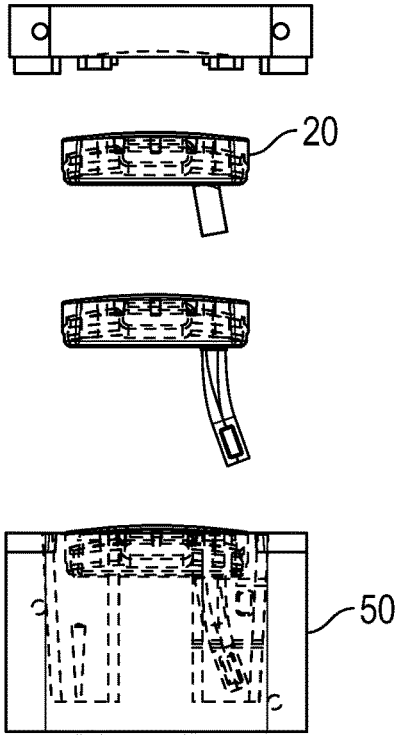
Figure 7:
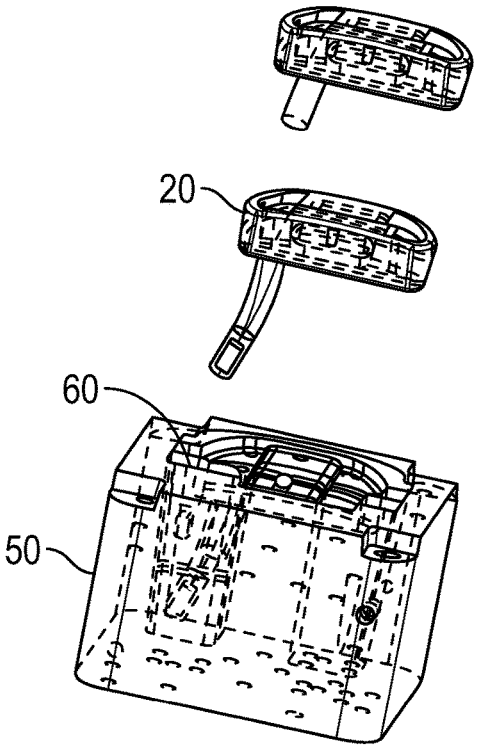
FIGS. 7-8 are exploded views of the embodiment shown in FIG. 2 with the cover removed.
Figure 8:
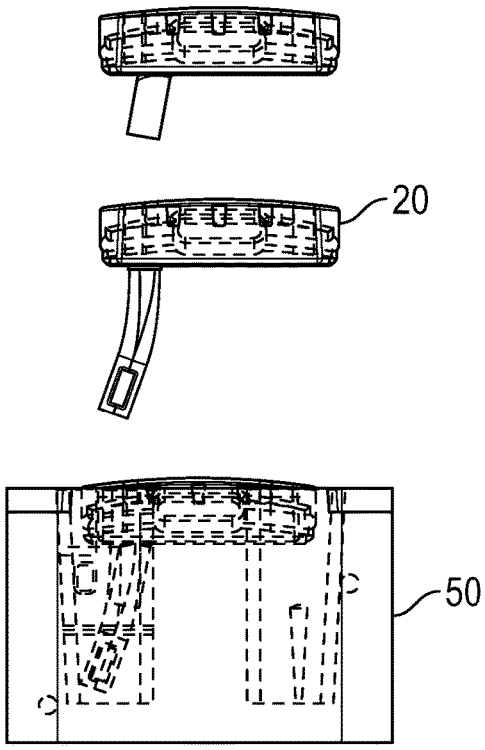
Figure 9:
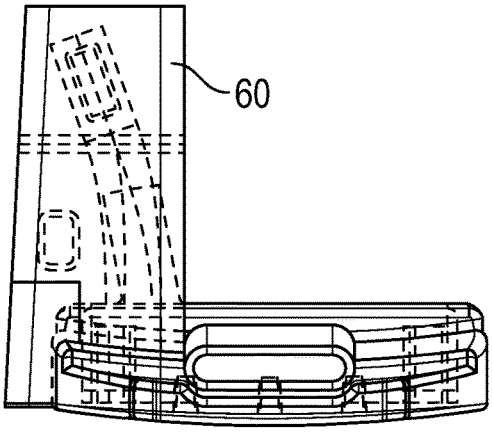
FIGS. 9-12 are side and top views of an exemplary golf club head engaged with a first hosel core.
Figure 10:
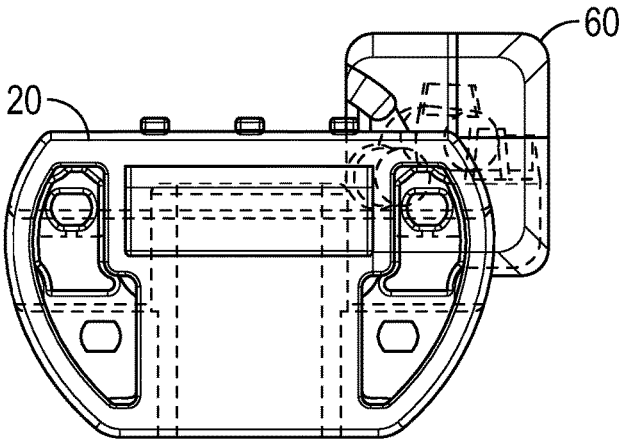
Figure 11:
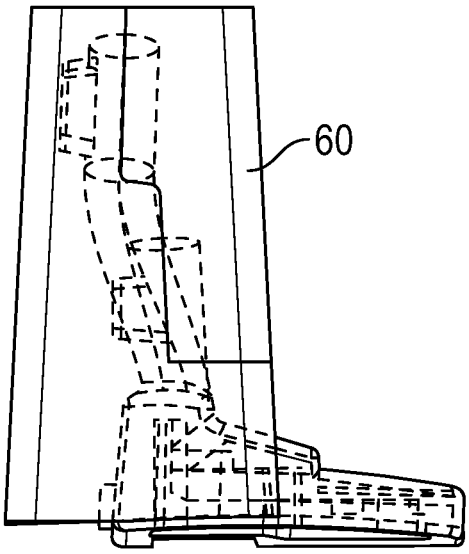
Figure 12:
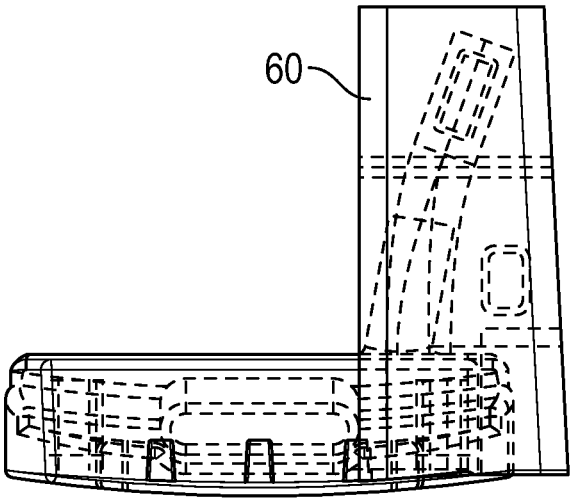
Figure 13:
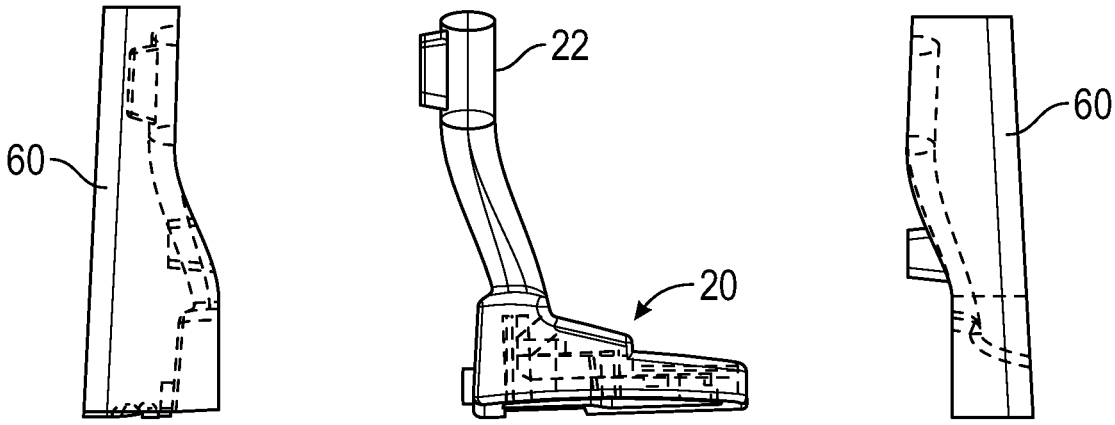
FIGS. 13-16 are exploded views of the golf club head engaged with the hosel core shown in 9-12.
Figure 14:
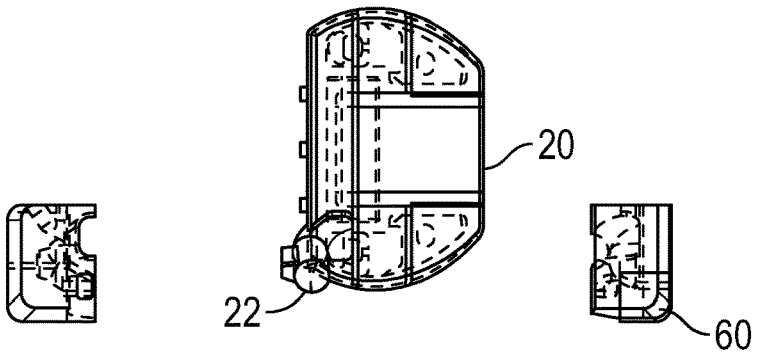
Figure 15:
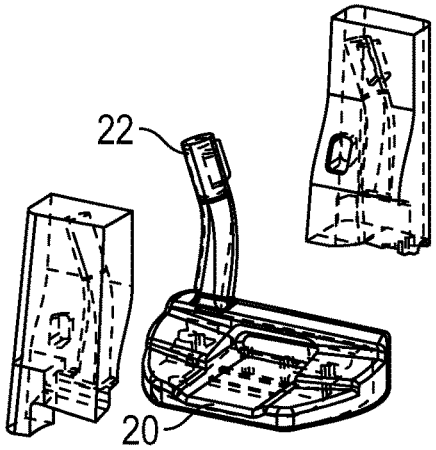
Figure 16:
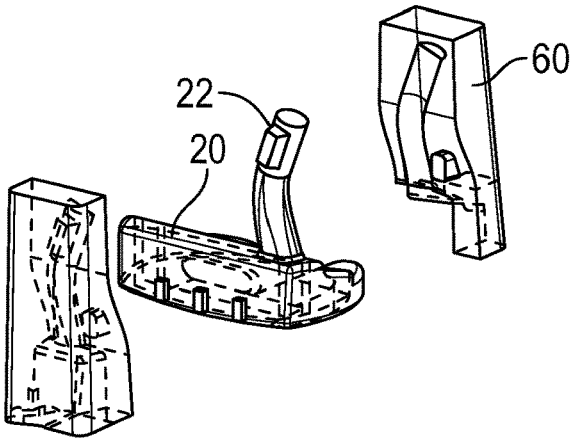
Figure 17:
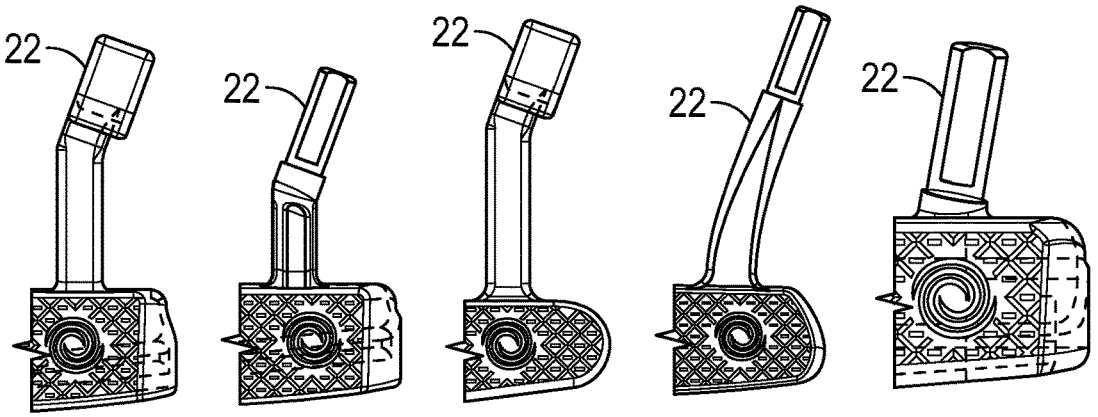
FIG. 17 are views of putter heads engaged with various hosels that can be created using the hosel cores described in the present invention.

The present invention is directed to golf club heads, and particularly putter heads, that are created via metal injection molding (MIM) within a tool that has interchangeable hosel cores, and are then finished with plasma polishing. MIM is the preferred manufacturing process because it allows for the creation of complex three dimensional geometries. The preferred method 100 of the present invention is illustrated in FIG. 1, and drawings of the various tooling pieces 50 and putter head 10 parts illustrated in FIGS. 2-17.

In a first step 110, metal powder is blended in a mixer with a polymer to create a stock feed material. The metal powder is preferably composed of 304 stainless steel, though it in alternative embodiments it may comprise or be composed of another metal alloy. In a second step 115, the stock feed material is heated in an extrusion machine hopper to create a liquid material. In third step 120, which may be performed simultaneously with the first and second steps 110, 115, a first, base tool 50 with a putter head-shaped cavity 52 is loaded into an extruder machine. This base tool 50 also includes a hosel cavity 54 sized to receive a hosel core tool 60, which can be designed to mold any hosel 12 construction conforming with USGA criteria.

In a fourth step 125, one of a plurality of hosel core tools 60 are engaged with the first tool 50 to create a combination tool 70. The use of interchangeable hosel core tools 60 allows a manufacturer to quickly and easily alter the overall shape of the putter head 10, and greatly reduces the number of base tools 50 needed to create an entire line of putter heads 10 with different hosel 12 designs. In prior art processes, the intricate design shapes of putter hosels 12 did not allow the usage of forging to create more than one tool for each head shape. By using a MIM process with the tools 50, 60 of the present invention, a manufacturer can quickly and easily create many unique putter head 10 designs.

Once all components of the tools 50, 60 are secured in place, the manufacturing chamber of the machine is closed so that the injection molding process can begin. In a fifth step 130, the liquid material is injected into the combination tool 70 to form a first intermediate putter head 20 with a hosel 22 corresponding to the selected hosel core tool 60. The specific time, heat, and holding pressure parameters under which this fifth step 130 are performed are tailored for the style of putter head 10, depending on its body shape and the shape of the hosel selected via an interchangeable hosel core tool 60.

In a sixth step 135, the combination tool 70 undergoes a cooling operation so that the liquid material hardens into a first intermediate product 20, and in a seventh step 140, the first intermediate product 20 is removed from the combination tool and placed into a sintering oven to melt away polymer material, leaving only SS304 material. During this process, the overall shape and size of the first intermediate product 20 shrinks as the polymer material is removed, leaving a second intermediate product 30. The metal injection molding process allows this second intermediate product 30 to be almost identical to the ideal design shape, e.g., "near-final," with precision within thousandths of inches. By moving to the MIM process, less material is wasted, less CNC machine time is required to machine to final part, and a precision, mass-produced part can be obtained. This technology also can produce shapes that were unobtainable with previous technology. This process has less human involvement and is far more automated, which decreases the amount of operators needed to manage process and also makes parts more easily obtainable.

In an optional, eighth step 145, the second intermediate product 30 may be subjected to a CNC machining process to remove small burs or imperfections. The use of CNC machining in the inventive process is minimal compared with prior art manufacturing processes.

Figure 18:
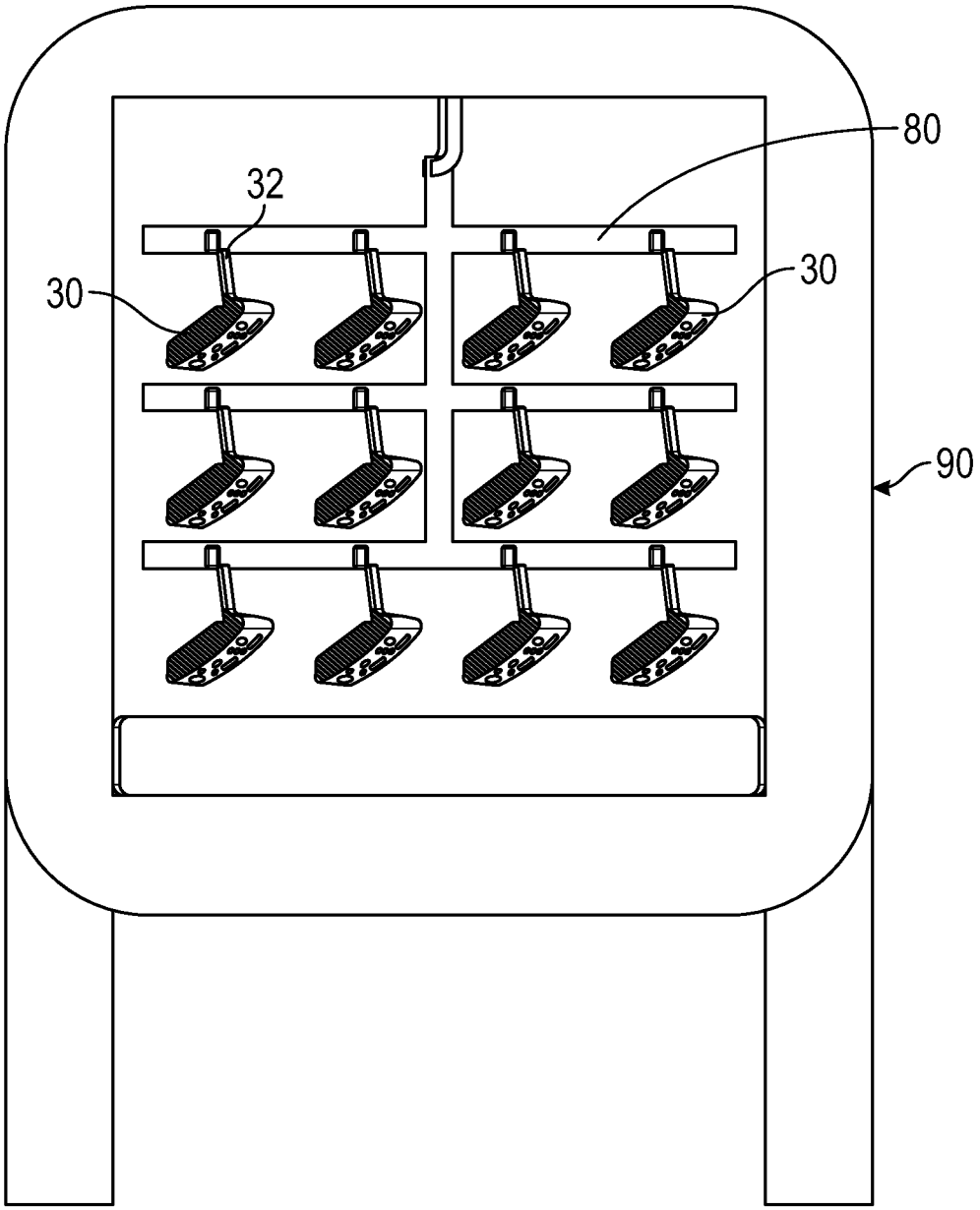
FIG. 18 is a drawing of a plasma polishing assembly described herein.

In a ninth step 150, the second intermediate product 30 is affixed with other second intermediate products 30 onto a metal tree housing 80 via their hosels 32, as illustrated in FIG. 18. In a tenth step 155, the metal tree housing 80 is loaded into a plasma polishing chamber 90 and clamped into place so that the second intermediate products are suspended from an aqueous solution of 2.5-5% NaCl solute and water. In an eleventh step 160, the temperature and the current are increased to desired levels, which preferably are no more than 100° C. and no less than 200 volts, respectively. The tree housing 80 spaces the second intermediate products 30 from one another and allows current from the machine to be evenly distributed between all second intermediate products 30. In a twelfth step 165, the second intermediate products 30, now anodically polarized, are placed into solution, where surface micro-discharges occur in process-induced formation of a plasma cloud around the heads, micro leveling the material with minimal material loss, and creating finished putter heads 10. This plasma polishing process yields a glossy cosmetic shine appearance, increases corrosion and rust resistance, and provides a smoother surface to which post process operations can adhere.

In a thirteenth step 170, the putter heads 10 are removed from the plasma polishing machine and cleaned. The manufacturer can then paint, apply decals, or otherwise decorate the finished putter heads 10 in preparation for sale.

In an alternative embodiment, one or more putter heads 10 (or other types of golf club heads) created via form, investment, die, or permanent mold casting processes, or machined entirely from a billet, can be plasma polished according to the ninth, tenth, eleventh, and twelfth steps 150, 155, 160, 165.

Though described and illustrated herein in connection with putter heads 10, the methods of the present invention can be used to create other types of golf club heads, including drivers, fairway woods, irons, wedges, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A method comprising the steps of:

blending a metal powder with a polymer to create a stock feed material;

heating the stock feed to create a liquid material;

providing a base tool with a putter head-shaped cavity and a first hosel cavity;

providing a plurality of hosel core tools, each having a second hosel cavity with a shape that differs from a shape of each other hosel cavity of the plurality of hosel core tools;

inserting one of the plurality of hosel core tools into the first hosel cavity to create a combination tool with a combination cavity;

injecting the liquid material into the combination cavity;

cooling the combination tool so that the liquid material hardens into a first intermediate product having a size and shape of the combination cavity;

removing the first intermediate product from the combination tool;

heating the first intermediate product to melt away the polymer material and create a second intermediate product having a smaller size than the first intermediate product;

affixing the second intermediate product to a tree housing;

placing the tree housing into a chamber comprising an aqueous solution comprising 2.5-5% NaCl;

increasing temperature to no more than 100° C. and voltage levels to no less than 200 volts within the chamber to anodically polarize the second intermediate product;

placing the second intermediate product into the aqueous solution to create a putter head; and removing the putter head from the chamber.

2. The method of claim 1, wherein the metal powder is stainless steel.

3. The method of claim 2, wherein the metal powder is 304 stainless steel.

4. The method of claim 1, further comprising the step of decorating the finished putter head.

5. The method of claim 4, wherein the step of decorating the finished putter head comprises painting the putter head.

6. The method of claim 4, wherein the step of decorating the finished putter head comprises applying decals to the putter head.

* * * * *